US009087485B2

(12) United States Patent
Ahn et al.

(10) Patent No.: US 9,087,485 B2
(45) Date of Patent: Jul. 21, 2015

(54) LOCAL DIMMING DRIVING METHOD AND DEVICE OF LIQUID CRYSTAL DISPLAY DEVICE

(75) Inventors: Hee-Won Ahn, Gyeonggi-do (KR); Si-Hoon Lee, Incheon (KR); Kyung-Joon Kwon, Seoul (KR); Kyo-Hyuck Choo, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1086 days.

(21) Appl. No.: 12/962,710

(22) Filed: Dec. 8, 2010

(65) Prior Publication Data

US 2011/0141166 A1 Jun. 16, 2011

(30) Foreign Application Priority Data

Dec. 11, 2009 (KR) ..... 10-2009-0123194

(51) Int. Cl.
*G09G 3/36* (2006.01)
*G09G 3/34* (2006.01)

(52) U.S. Cl.
CPC ..... *G09G 3/3426* (2013.01); *G09G 3/3648* (2013.01); *G09G 2320/0242* (2013.01); *G09G 2320/0646* (2013.01); *G09G 2330/021* (2013.01); *G09G 2360/16* (2013.01)

(58) Field of Classification Search
CPC ..... G09G 3/3406; G09G 2320/0276
USPC ..... 345/102, 690
See application file for complete search history.

(56) References Cited

U.S. PATENT DOCUMENTS

2008/0106544 A1 5/2008 Lee et al.
2008/0143753 A1 6/2008 Ou-Yang et al.
2008/0278432 A1 11/2008 Ohshima
2009/0091660 A1 4/2009 Wang et al.
2009/0184906 A1* 7/2009 Park et al. ..... 345/84

(Continued)

FOREIGN PATENT DOCUMENTS

CN 101211537 A 7/2008
CN 101303839 A 11/2008

(Continued)

OTHER PUBLICATIONS

Office Action issued in corresponding Chinese Patent Application No. 201010238122.6 dated Jun. 18, 2012.

(Continued)

*Primary Examiner* — Amr Awad
*Assistant Examiner* — Aaron Midkiff
(74) *Attorney, Agent, or Firm* — Morgan, Lewis & Bockius LLP

(57) ABSTRACT

Disclosed herein is a local dimming driving method and device of a Liquid Crystal Display (LCD) device, which is capable of preventing color change due to gray scale saturation when data is compensated while enabling local dimming. The local dimming driving method of the LCD device includes detecting maximum values per pixel from input image data, analyzing the maximum values per pixel on a block-by-block basis, and determining local dimming values per block according to the analysis result, calculating a first gain value using the local dimming values per block, calculating a maximum gain value per pixel using the maximum value per pixel as a second gain value, selecting a smaller value of the first and second gain values as a final gain value, compensating the input image data using the final gain value, and controlling luminance of a backlight unit on the block-by-block basis using the local dimming value per block.

17 Claims, 5 Drawing Sheets

(56) References Cited

U.S. PATENT DOCUMENTS

| | | | | |
|---|---|---|---|---|
| 2009/0184917 | A1 | 7/2009 | Park et al. | |
| 2010/0259689 | A1 * | 10/2010 | Tanaka et al. | 348/708 |

FOREIGN PATENT DOCUMENTS

| | | | |
|---|---|---|---|
| TW | 200822015 | A | 5/2008 |
| TW | 200917155 | A | 4/2009 |
| TW | 200933586 | A | 8/2009 |

OTHER PUBLICATIONS

Office Action issued in corresponding Taiwanese Patent Application No. 10220944670 dated Jul. 18, 2013.

* cited by examiner

LOCAL DIMMING DRIVING METHOD AND DEVICE OF LIQUID CRYSTAL DISPLAY DEVICE

This application claims the benefit of Korean Patent Application No. 10-2009-0123194, filed on Dec. 11, 2009, which is hereby incorporated by reference as if fully set forth herein.

BACKGROUND OF THE INVENTION

1. Field of the Invention

The present invention relates to a Liquid Crystal Display (LCD) device, and more particularly, to a local dimming driving method and device of an LCD device, which is capable of preventing color change due to gray scale saturation when data is compensated while enabling local dimming.

2. Discussion of the Related Art

Recently, as an image display device, a flat panel display device such as a Liquid Crystal Display (LCD) device, a Plasma Display Panel (PDP) device, or an Organic Light Emitting Diode (OLED) device is mainly used.

An LCD device includes a liquid crystal panel for displaying an image using a pixel matrix using electrical and optical characteristics of liquid crystal with anisotropy of a refractive index and a dielectric constant, a driving circuit for driving the liquid crystal panel, and a backlight unit for irradiating light to the liquid crystal panel. Each pixel of the LCD device expresses gray scales, by changing a liquid crystal arrangement direction according to a data signal so as to control transmittance of light from the backlight unit through the liquid crystal panel and a polarization plate.

In the LCD device, the luminance of each pixel is determined by a product of the luminance of the backlight unit and light transmittance of liquid crystal according to data. The LCD device uses a backlight dimming method for analyzing an input image, controlling a dimming value so as to control the luminance of the backlight unit and compensating data, in order to improve a contrast ratio and reduce power consumption. For example, a backlight dimming method decreases the luminance of the backlight unit by decreasing the dimming value and increases the luminance of the backlight unit by compensating data, thereby reducing power consumption of the backlight unit. Most backlight dimming methods allow gray scale saturation, for efficient data compensation. However, when data allowing gray scale saturation is compensated, a color may be changed. That is, the backlight dimming method compensates data by multiplying input data by a gain value detected by the analysis of the input image. However, if the input data includes data allowing gray scale saturation, a color may be changed due to compensation of the data allowing gray scale saturation.

For example, when gray scale saturation is allowed with respect to a gray scale value of data "180" or more, if input R/G/B data "240/200/180" is multiplied by a gain value "1.5" so as to change input R/G/B data to output R/G/B data "255/255/255", input data close to red is changed to white output data, thereby causing color distortion. If input R/G/B data "100/100/200" is multiplied by a gain value "2" so as to change the input R/G/B data to output R/G/B data "200/200/255", input data close to blue is changed to output data close to white, thereby causing color distortion.

SUMMARY OF THE INVENTION

Accordingly, the present invention is directed to a local dimming driving method and device of a Liquid Crystal Display (LCD) device that substantially obviates one or more problems due to limitations and disadvantages of the related art.

An object of the present invention is to provide a local dimming driving method and device of an LCD device, which is capable of preventing color change due to gray scale saturation when data is compensated while enabling local dimming.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a local dimming driving method of a liquid crystal display device includes detecting maximum values per pixel from input image data, analyzing the maximum values per pixel on a block-by-block basis, and determining local dimming values per block according to the analysis result, calculating a first gain value using the local dimming values per block, calculating a maximum gain value per pixel using the maximum value per pixel as a second gain value, selecting a smaller value of the first and second gain values as a final gain value, compensating the input image data using the final gain value, and controlling luminance of a backlight unit on the block-by-block basis using the local dimming value per block.

The determining of the local dimming values per block may include detecting the maximum values per pixel from the input image data, summing and averaging the maximum values per pixel on the block-by-block basis and detecting average values per block, and selecting and outputting the local dimming values per block corresponding to the average values per block using a predetermined look-up table.

The calculating of the first gain value may include calculating a first total quantity of light reaching each pixel using a predetermined light profile of a light source, when the luminance of the backlight unit has a maximum value, calculating a second total quantity of light reaching each pixel using the local dimming values per block and the light profile when the luminance of the backlight unit is controlled on a block-by-block basis, and calculating the first gain value by a ratio of the first total light quantity to the second total light quantity on a pixel-by-pixel basis.

The second gain value may be calculated by a ratio of a maximum gray scale corresponding to the number of bits of the input image data to the maximum value per pixel on a pixel-by-pixel basis.

The second gain value may be calculated using a look-up table in which the characteristics of a ratio of a maximum gray scale corresponding to the number of bits of the input image data to the maximum value per pixel are previously set, on a pixel-by-pixel basis.

In another aspect of the present invention, a method of driving a liquid crystal display device includes supplying the compensated data to a liquid crystal panel using the local dimming driving method, and displaying the input image data by a combination of the luminance of the backlight unit controlled on the block-by-block basis and light transmittance controlled by the compensated data on the liquid crystal panel.

In another aspect of the present invention, a local dimming driving device of a liquid crystal display device includes an image analyzer detecting maximum values per pixel from input image data and analyzing the maximum values per pixel on a block-by-block basis, a dimming value decider determining and outputting local dimming values per block according to the analysis result from the image analyzer, a first gain value calculator calculating and outputting a first gain value using the local dimming values per block from the dimming value decider, a second gain value calculator calculating and outputting a maximum gain value per pixel using the maximum values per pixel from the image analyzer as a second gain value, a gain value selector selecting and outputting a smaller value of the first gain value from the first gain value calculator and the second gain value from the second gain value as a final gain value, and a data compensator compensating the input image data using the final gain value.

The image analyzer may include a maximum value detector detecting and outputting the maximum values per pixel from the input image data, and an average value detector summing and averaging the maximum values per pixel from the maximum value detector on the block-by-block basis, and detecting and outputting average values per block to the dimming value decider, and the dimming value decider selecting and outputting the local dimming values per block corresponding to the average vales per block using a predetermined look-up table.

The first gain value calculator may calculate a first total quantity of light reaching each pixel using a predetermined light profile of a light source when luminance of a backlight unit has a maximum value, calculate a second total quantity of light reaching each pixel using the local dimming values per block and the light profile when the luminance of the backlight unit is controlled on the block-by-block basis, and calculate and output the first gain value by a ratio of the first total light quantity to the second total light quantity on a pixel-by-pixel basis.

The second gain value calculator may calculate and output the second gain value on a pixel-by-pixel basis by calculating a ratio of a maximum gray scale corresponding to the number of bits of the input image data to the maximum value per pixel.

The second gain value calculator may calculate the second gain value on a pixel-by-pixel basis using a look-up table in which the characteristics of a ratio of a maximum gray scale corresponding to the number of bits of the input image data to the maximum value per pixel are previously set.

In another aspect of the present invention, a liquid crystal display device includes the local dimming driver as recited above, a panel driver supplying the compensated data from the local dimming driver to a liquid crystal panel, a timing controller outputting the compensated data from the local dimming driver to the panel driver and controlling driving timing of the panel driver, a backlight unit including a plurality of light emitting blocks to irradiate light to the liquid crystal panel, and a backlight driver driving the light emitting blocks using the local dimming values per block from the local dimming driver.

The local dimming driver may be built in the timing controller.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
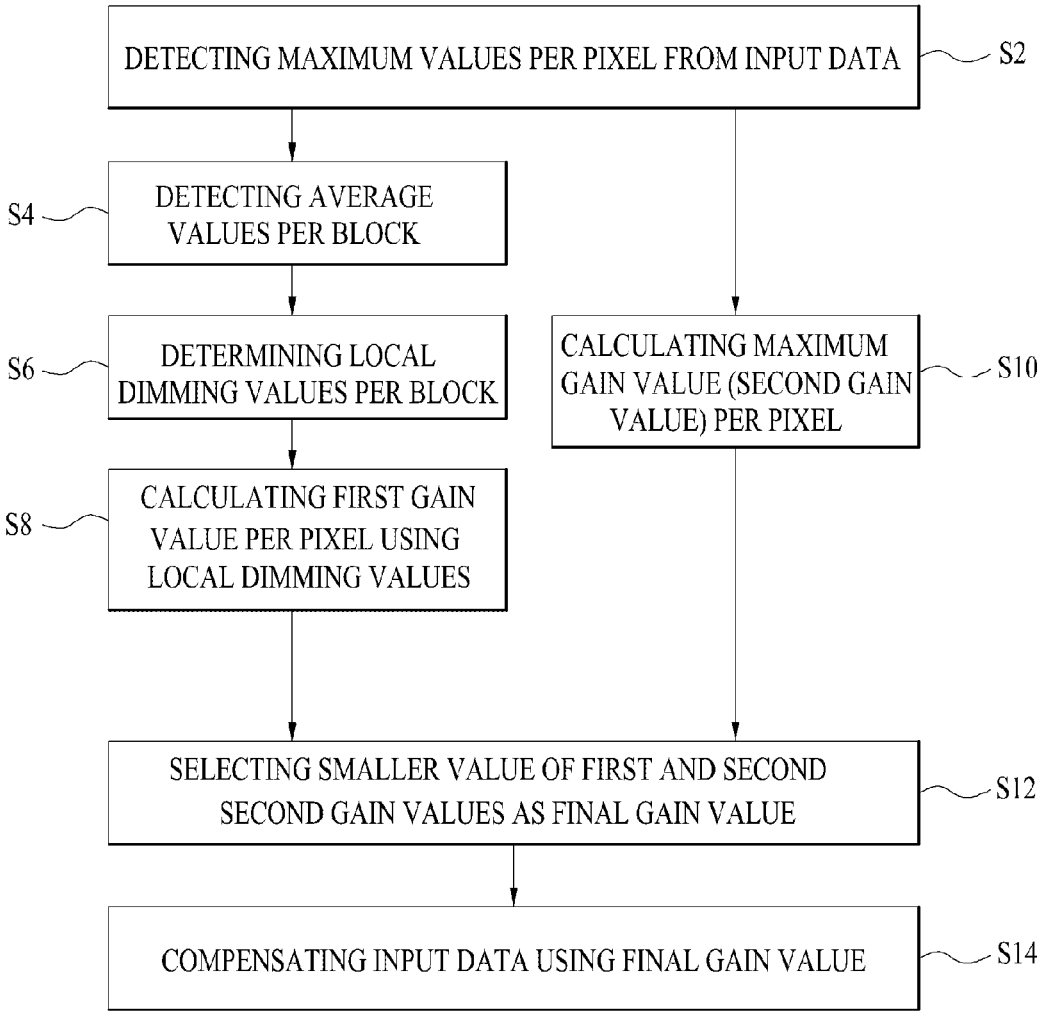
FIG. 1 is a flowchart illustrating a local dimming driving method of a Liquid Crystal Display (LCD) device according to an embodiment of the present invention.

FIG. 1 is a flowchart illustrating a local dimming driving method of a Liquid Crystal Display (LCD) device according to an embodiment of the present invention.

In a step 2 (S2), maximum values per pixel are detected from externally input data. Data with a maximum value is detected from externally input R/G/B data as the maximum values per pixel.

In step 4 (S4), the maximum values per pixel are divided into units of light emitting blocks, and the maximum values per pixel are summed and averaged on a block-by-block basis, thereby detecting average values per block.

In step 6 (S6), local dimming values per block corresponding to the average values per block are determined. In general, since a designer previously sets the local dimming values corresponding to the average values per block in a look-up table, the local dimming values corresponding to the average values per block are selected from the look-up table and are output. The local dimming values determined on a block-by-block basis are realigned in connection order of the blocks within a backlight unit and are supplied to a backlight driver such that the backlight driver controls the luminance of the backlight unit according to the local dimming values per block.

In step 8 (S8), a first gain value per pixel for data compensation is calculated using the local dimming values determined on the block-by-block basis. In detail, in a local dimming driving method of dividing an LED backlight unit into a plurality of blocks and driving the plurality of blocks so as to control the luminance of the backlight unit on the block-by-block basis, since luminance is reduced as compared with a global dimming driving method for controlling the overall luminance of a backlight unit, the backlight luminance reduced by using the local dimming driving method is compensated using data.

The quantity of light reaching each pixel is calculated from a light profile numerically representing the light emission characteristics of a light source according to distances, thereby calculating the first gain value. In detail, the first gain value is detected by a ratio of a first total quantity of light reaching each pixel from each light source (or each light block) when the overall luminance of the backlight unit has a maximum value to a second total quantity of light reaching each pixel from each light source (or each light block) when the backlight luminance is controlled by local dimming on the block-by-block basis, as expressed by Equation 1.

First gain value per pixel=(first total light quantity per pixel at maximum backlight luminance)/(second total light quantity per pixel at backlight luminance controlled by local dimming) Equation 1

The first total light quantity per pixel is calculated by detecting and summing the quantity of light reaching each pixel from the light profile when the overall luminance of the backlight unit has a maximum value, and the second total light quantity per pixel is calculated by summing the quantity of light reaching each pixel from the light profile multiplied by the local dimming values when the backlight luminance is controlled by local dimming on the block-by-block basis. As expressed by Equation 1, the ratio of the first total light quantity per pixel to the second total light quantity is calculated as the first gain value per pixel.

In step 10 (S10), a second gain value per pixel which is a maximum gain value per pixel is calculated using the maximum values per pixel detected in step 2 (S2). The second gain value per pixel is calculated by a ratio of a maximum gray scale (255 in case of 8-bit data) corresponding to the number of bits of current data to a maximum value of each pixel, as expressed by Equation 2.

Maximum gain value per pixel=255/maximum value per pixel Equation 2

The second gain value per pixel may be calculated by Equation 2 or using a predetermined look-up table in which maximum gain values per pixel are previously set according to maximum values per pixel.

In step 12 (S12), the first gain value per pixel calculated in step 8 (S8) is compared with the second gain value per pixel calculated in step 10 (S10), a smaller value of the two values is selected and is output as a final gain value, and the input data is multiplied by the final gain value in step 14 (S14) so as to compensate the input data. This is because, when the maximum value per pixel is multiplied by the gain value upon data compensation, the final gain value is restricted such that the gray scale of a pixel with gray scale saturation does not exceed a maximum gray scale (generally, 255).

In the local dimming driving method of the LCD device according to the present invention, a smaller value of the first gain value per pixel calculated for compensating for the luminance reduced by local dimming and the second gain value which is the maximum gain value per pixel calculated using the maximum value per pixel is selected as the final gain value for data compensation so as to prevent the final gain value per pixel from exceeding the maximum gain value per pixel. Therefore, since the input color can be maintained while the maximum value of the data compensated by a product of the input data and the final gain value does not exceed the maximum gray scale (255), it is possible to prevent color distortion due to gray scale saturation upon data compensation.

Figure 3:
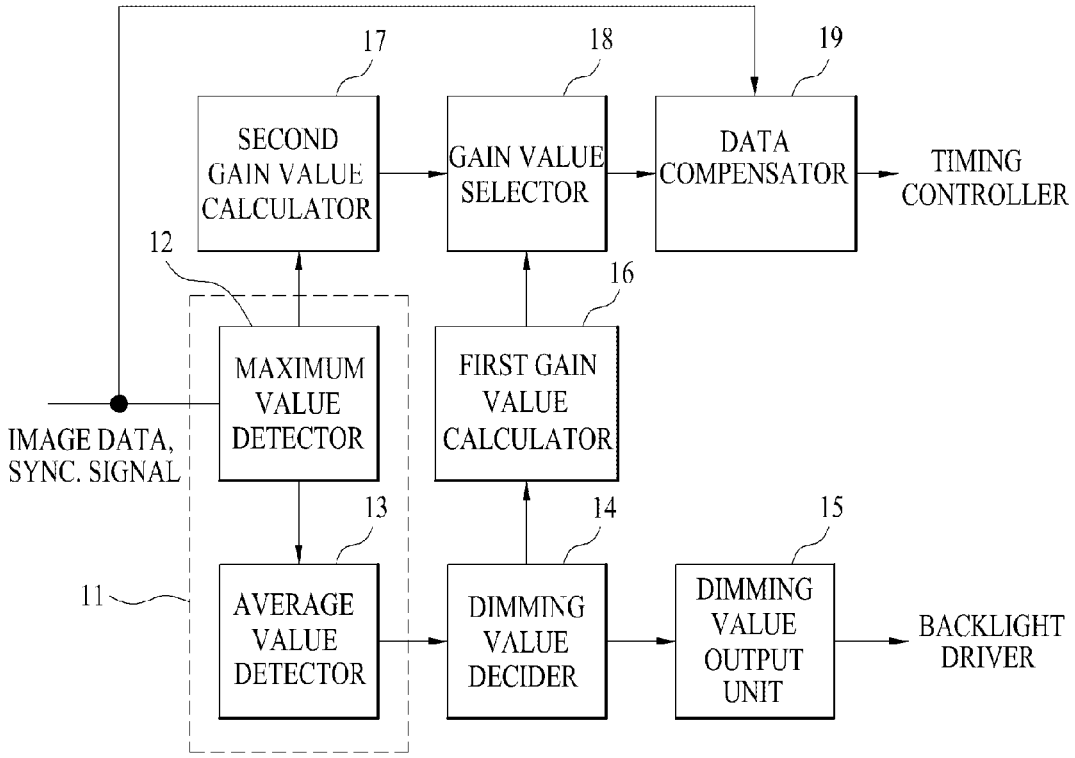
FIG. 3 is a block diagram showing a local dimming driver of an LCD device of an embodiment of the present invention.

FIG. 3 is a block diagram showing a local dimming driver of an LCD device of an embodiment of the present invention.

The local dimming driver 10 shown in FIG. 3 includes an image analyzer 11, a dimming value decider 14, a dimming value output unit 15, a first gain value calculator 16, a second gain value calculator 17, a gain value selector 18, and a data compensator 19.

The image analyzer 11 includes a maximum value detector 12 and an average value detector 13. The maximum value detector 12 detects maximum values per pixel from externally input data and outputs the maximum values to the average value detector 13 and the second gain value calculator 17. The maximum value detector 12 detects and outputs data with a maximum value from externally input R/G/B data of each pixel as the maximum values per pixel.

The average detector 13 divides the maximum values per pixel from the maximum value detector 12 in units of light emitting blocks of the backlight unit, sums and averages the maximum values per pixel on the block-by-block basis, and detects and outputs averages per block to the dimming value decider 14.

The dimming value decider 14 determines and outputs the local dimming values per block corresponding to the average values per block from the average value detector 13 to the dimming value output unit 15 and the first gain value calculator 16. The dimming value decider 14 selects and outputs the local dimming values per block corresponding to the average values per block using the predetermined look-up table.

The dimming value output unit 15 realigns the local dimming values per block from the dimming value decider 14 in the connection order of the blocks within the backlight unit. The backlight driver can control the luminance of the backlight unit on the block-by-block basis according to the local dimming values.

The first gain value calculator 16 calculates the first gain value per pixel using the local dimming values per block from the dimming value decider 14. The first gain value calculator 16 calculates the first total quantity of light reaching each pixel when the overall luminance of the backlight unit has a maximum value and the second total quantity of light reaching each pixel when the luminance of the backlight unit is controlled by local dimming on the block-by-block basis, calculates the first gain value which is the ratio of the first total light quantity to the second total light quantity, and outputs the first gain value to the gain value selector 18. The first total light quantity per pixel is calculated by detecting and summing the quantity of light reaching each pixel from the light profile when the overall luminance of the backlight unit has a maximum value, and the second total light quantity per pixel is calculated by summing the quantity of light reaching each pixel from the light profile multiplied by the local dimming values when the luminance of the backlight unit is controlled by local dimming on the block-by-block basis.

Figure 2:
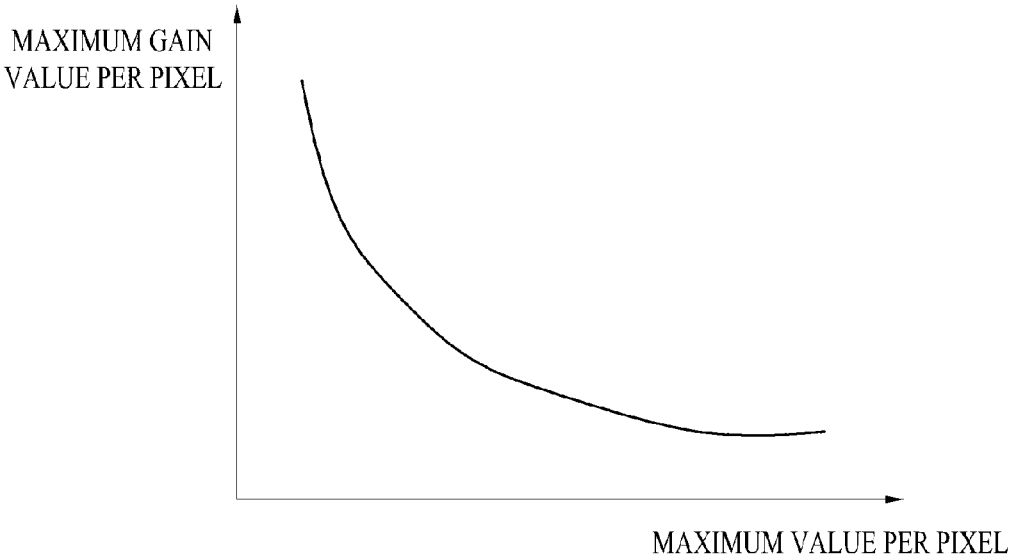
FIG. 2 is a diagram showing the characteristics of a maximum gain value per pixel according to a maximum value per pixel applied to FIG. 1.

The second gain value calculator 17 calculates the second gain value per pixel, which is the maximum gain value per pixel, using the maximum values per pixel from the maximum value detector 12 and outputs the second gain value per pixel to the gain value selector 18. The second gain value per pixel is calculated by a ratio of the maximum gray scale (255) to the maximum value of each pixel (255/maximum value per pixel), as expressed by Equation 2. The second gain value calculator 17 calculates the second gain value per pixel by Equation 2 using a division operator or by the look-up table in which the maximum gain values per pixel are previously set according to the maximum values per pixel as shown in FIG. 2.

The gain value selector 18 compares the first gain value per pixel from the first gain value calculator 16 with the second gain value per pixel from the second gain value calculator 17, selects a smaller value of the gain values as the final gain value, and outputs the final gain value to the data compensator 19. The gain value selector 18 selects a smaller value of the first gain value per pixel calculated for compensating for luminance reduced by local dimming and the second gain value which is the maximum gain value per pixel calculated using the maximum value per pixel as the final gain value for data compensation such that the final gain value per pixel does not exceed the maximum gain value per pixel.

The data compensator 19 multiplies the input data by the final gain value from the gain value selector 18 so as to compensate the input data in terms of luminance, and outputs the compensated data to a timing controller. Since the final gain value from the gain value selector 18 does not exceed the maximum gain value per pixel, it is possible to maintain an input color while the maximum value of the data compensated by the product of the input data and the final gain value does not exceed the maximum gray scale 255. Thus, it is possible to prevent color distortion due to gray scale saturation upon data compensation.

Figure 4:
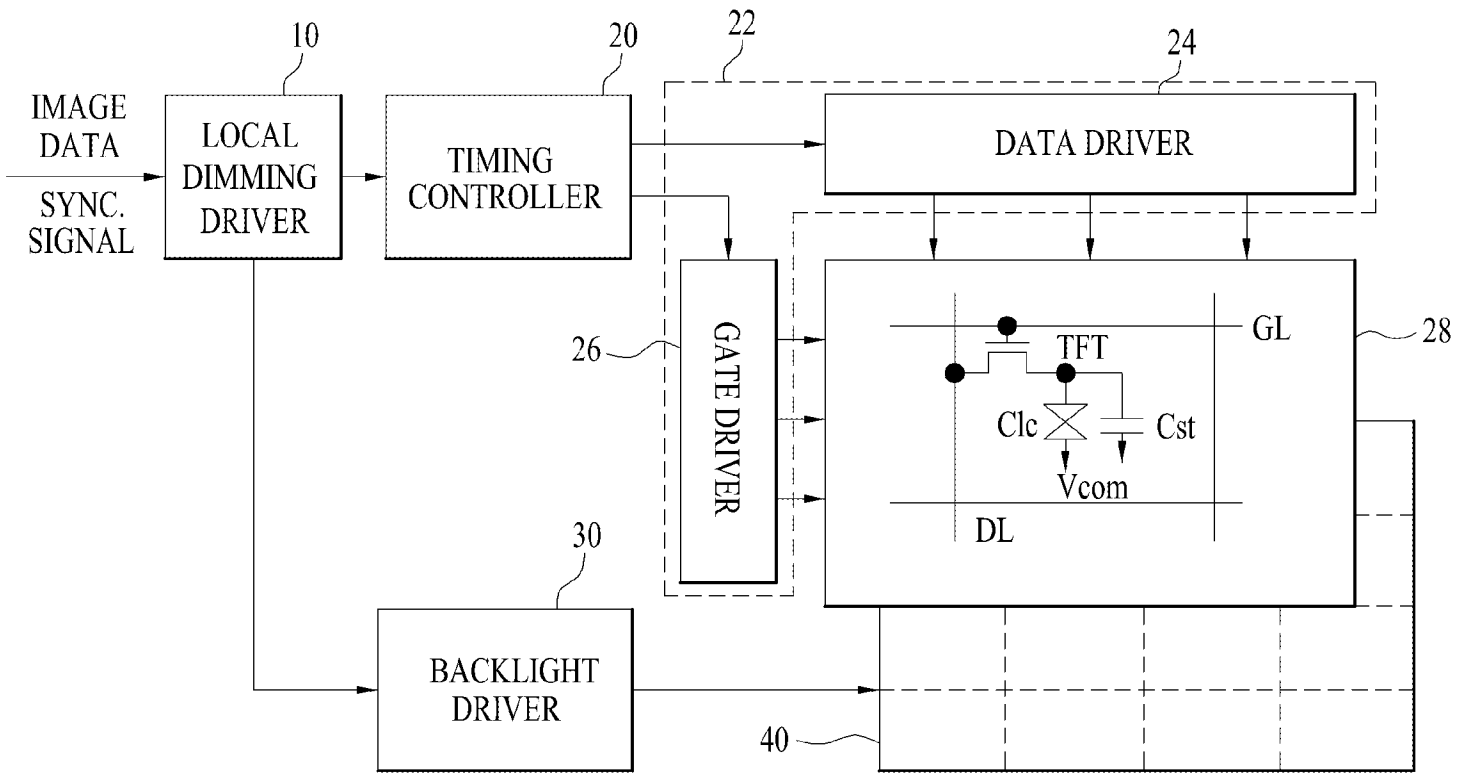
FIGS. 4 and 5 are diagrams showing LCD devices according to embodiments of the present invention.
Figure 5:
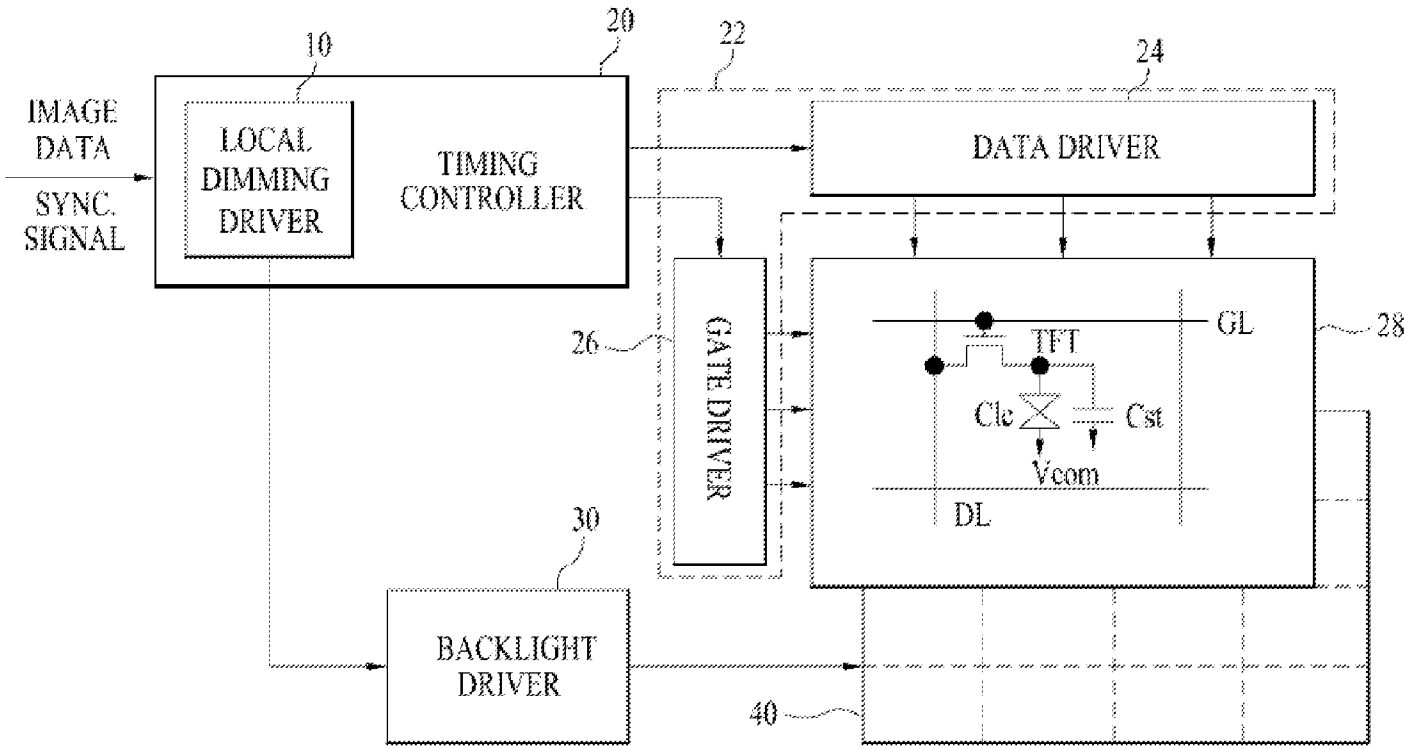

FIGS. 4 and 5 are diagrams showing LCD devices according to embodiments of the present invention, to which the local dimming driver 10 shown in FIG. 3 is applied.

The LCD device shown in FIG. 4 includes a local dimming driver 10 analyzing input image data in units of a plurality of blocks, determining the local dimming values, and compensating data, a timing controller 20 supplying output data from the local dimming driver 10 to a panel driver 22 and controlling driving timing of the panel driver 22, a backlight driver 30 driving an LED backlight unit 40 based on the local dimming values per block from the local dimming driver 10 on the block-by-block basis, and a liquid crystal panel 28 driven by a data driver 24 and a gate driver 26 of the panel driver 22. The local dimming driver 10 may be built in the timing controller 20 as shown in FIG. 5.

The local dimming driver 10 analyzes data in the units of the plurality of blocks using the input image data and a synchronization signal and determines the local dimming values per block according to the analysis result. The local dimming driver 10 calculates the first gain value per pixel using the local dimming values per block and calculates the second gain value which is the maximum gain value per pixel using the maximum values per pixel. The local dimming driver 10 selects the smaller value of the first gain value and the second gain value as the final gain value, compensates the input data in terms of luminance by the product of the input image data and the final gain value, and outputs the compensated data to the timing controller 20. The local dimming driver 10 realigns the local dimming values determined on the block-by-block basis in the connection order of the blocks within the backlight unit 40 and supplies the realigned local dimming values to the backlight driver 30.

The timing controller 20 aligns the output data from the local dimming driver 10 and outputs the output data to the data driver 24 of the panel driver 22. The timing controller 20 generates a data control signal for controlling the driving timing of the data driver 24 and a data control signal for controlling the driving timing of the gate driver 26, using a plurality of synchronization signals, that is, a vertical synchronization signal, a horizontal synchronization signal, a data enable signal and a dot clock, received from the local dimming driver 10, and respectively outputs the data control signal and the gate control signal to the data driver 24 and the gate driver 26. The timing controller 20 may further include an over-driving circuit (not shown) for adding an overshoot value or an undershoot value according to a data difference between neighboring frames so as to change data, in order to improve a response speed of liquid crystal.

The panel driver 22 includes the data driver 24 for driving data lines DL of the liquid crystal panel 28 and the gate driver 26 for driving gate lines GL of the liquid crystal panel 28.

The data driver 24 converts digital image data from the timing controller 24 into analog data signal (pixel voltage signal) using a gamma voltage in response to the data control signal from the timing controller 20 and supplies the analog data signal to the data lines DL of the liquid crystal panel 28.

The gate driver 26 sequentially drives the gate lines GL of the liquid crystal panel 28 in response to the gate control signal from the timing controller 20.

The liquid crystal panel 28 displays an image through a pixel matrix in which a plurality of pixels is arranged. Each pixel exhibits a desired color by a combination of red, green and blue sub-pixels for controlling light transmittance by changing liquid crystal arrangement according to the data signal, the luminance of which is compensated. Each sub-pixel includes a Thin-Film Transistor (TFT) connected to each gate line GL and data line DL, a liquid crystal capacitor Clc connected to the TFT in parallel, and a storage capacitor Cst. The liquid crystal capacitor Clc charges a differential voltage between the data signal supplied to a pixel electrode through the TFT and a common voltage Vcom supplied to a common electrode and drives the liquid crystal according to the charged voltage so as to control light transmittance. The storage capacitor Cst stably maintains the voltage charged in the liquid crystal capacitor Clc.

The backlight driver 30 drives the LED backlight unit 40 on a block-by-block basis according to the local dimming values per block from the local dimming driver 10 so as to control the luminance of the LED backlight unit 40 on the block-by-block basis. If the LED backlight unit 40 is driven in a state of being divided into a plurality of ports, a plurality of backlight drivers 30 for independently driving the plurality of ports may be included. The backlight driver 30 generates a Pulse Width Modulation (PWM) signal with a duty ratio corresponding to a local dimming value and supplies an LED driving signal corresponding to the generated PWM signal on the block-by-block basis, thereby driving the LED backlight unit 40 on the block-by-block basis. The backlight driver 30 sequentially drives the light emitting blocks using the local dimming value input in the block connection order from the local dimming driver 10 so as to control the luminance of the backlight unit on the block-by-block basis.

Accordingly, the LCD device of the present invention displays the input image data by the product of the backlight luminance controlled on the block-by-block basis and the light transmittance controlled by the compensated data on the liquid crystal panel.

In the local dimming driving method and device of the liquid crystal display device of the present invention, since a smaller value of the first gain value per pixel calculated for compensating for the luminance reduced by local dimming and the second gain value which is the maximum gain value per pixel calculated using the maximum value per pixel is selected as the final gain value for data compensation, the final gain value per pixel is prevented from exceeding the maximum gain value per pixel. Therefore, since the input color can be maintained while the maximum value of the data compensated by a product of the input data and the final gain value does not exceed the maximum gray scale (255), it is possible to prevent color distortion due to gray scale saturation upon data compensation.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A local dimming driving method of a liquid crystal display device, the local dimming driving method comprising:

detecting maximum values per pixel from input image data, analyzing the maximum values per pixel on a block-by-block basis, and determining local dimming values per block according to the analysis result;

calculating a first gain value using the local dimming values per block;

calculating a maximum gain value per pixel using the maximum value per pixel as a second gain value;

selecting a smaller value of the first and second gain values as a final gain value;

compensating the input image data using the final gain value; and controlling luminance of a backlight unit on the block-by-block basis using the local dimming value per block, wherein the calculating of the first gain value includes:

calculating a first total light quantity per pixel by detecting and summing the quantity of light reaching each pixel from a predetermined light profile of a light source, when the overall luminance of the backlight unit has a maximum value;

calculating a second total light quantity per pixel by summing the quantity of light reaching each pixel from the predetermined light profile of the light source multiplied by the local dimming values when the luminance of the backlight unit is controlled by local dimming on the block-by-block basis; and calculating the first gain value by a ratio of the first total light quantity to the second total light quantity on a pixel-by-pixel basis.

2. The local dimming driving method according to claim 1, wherein the determining of the local dimming values per block includes:

detecting the maximum values per pixel from the input image data;

summing and averaging the maximum values per pixel on the block-by-block basis and detecting average values per block; and selecting and outputting the local dimming values per block corresponding to the average values per block using a predetermined look-up table.

3. The local dimming driving method according to claim 1, wherein the second gain value is calculated by a ratio of a maximum gray scale corresponding to the number of bits of the input image data to the maximum value per pixel on a pixel-by-pixel basis.

4. The local dimming driving method according to claim 1, wherein the second gain value is calculated using a look-up table in which the characteristics of a ratio of a maximum gray scale corresponding to the number of bits of the input image data to the maximum value per pixel are previously set, on a pixel-by-pixel basis.

5. A method of driving a liquid crystal display device, the method comprising:

detecting maximum values per pixel from input image data, analyzing the maximum values per pixel on a block-by-block basis, and determining local dimming values per block according to the analysis result;

calculating a first gain value using the local dimming values per block;

calculating a maximum gain value per pixel using the maximum value per pixel as a second gain value;

selecting a smaller value of the first and second gain values as a final gain value;

compensating the input image data using the final gain value;

controlling luminance of a backlight unit on the block-by-block basis using the local dimming value per block;

supplying the compensated data to a liquid crystal panel; and displaying the input image data by a combination of the luminance of the backlight unit controlled on the block-by-block basis and light transmittance controlled by the compensated data on the liquid crystal panel, wherein the calculating of the first gain value includes:

calculating a first total light quantity per pixel by detecting and summing the quantity of light reaching each pixel from a predetermined light profile of a light source, when the overall luminance of the backlight unit has a maximum value;

calculating a second total light quantity per pixel by summing the quantity of light reaching each pixel from the predetermined light profile of the light source multiplied by the local dimming values when the luminance of the backlight unit is controlled by a local dimming on the block-by-block basis; and calculating the first gain value by a ratio of the first total light quantity to the second total light quantity on a pixel-by-pixel basis.

6. The method of driving the liquid crystal display device according to claim 5, wherein the determining of the local dimming values per block includes:

detecting the maximum values per pixel from the input image data;

summing and averaging the maximum values per pixel on the block-by-block basis and detecting average values per block; and selecting and outputting the local dimming values per block corresponding to the average values per block using a predetermined look-up table.

7. The method of driving the liquid crystal display device according to claim 5, wherein the second gain value is calculated by a ratio of a maximum gray scale corresponding to the number of bits of the input image data to the maximum value per pixel on a pixel-by-pixel basis.

8. The method of driving the liquid crystal display device according to claim 5, wherein the second gain value is calculated using a look-up table in which the characteristics of a ratio of a maximum gray scale corresponding to the number of bits of the input image data to the maximum value per pixel are previously set, on a pixel-by-pixel basis.

9. A local dimming driving device of a liquid crystal display device, the local dimming driving device comprising:

an image analyzer detecting maximum values per pixel from input image data and analyzing the maximum values per pixel on a block-by-block basis;

a dimming value decider determining and outputting local dimming values per block according to the analysis result from the image analyzer;

a first gain value calculator calculating and outputting a first gain value using the local dimming values per block from the dimming value decider;

a second gain value calculator calculating and outputting a maximum gain value per pixel using the maximum values per pixel from the image analyzer as a second gain value;

a gain value selector selecting and outputting a smaller value of the first gain value from the first gain value calculator and the second gain value from the second gain value calculator as a final gain value; and a data compensator compensating the input image data using the final gain value, wherein the first gain value calculator:

calculates a first total light quantity per pixel by detecting and summing the quantity of light reaching each pixel from a predetermined light profile of a light source when overall luminance of a backlight unit has a maximum value, calculates a second total light quantity per pixel by summing the quantity of light reaching each pixel from the predetermined light profile of the light source multiplied by the local dimming values when the luminance of the backlight unit is controlled by local dimming on the block-by-block basis, and calculates and outputs the first gain value by a ratio of the first total light quantity to the second total light quantity on a pixel-by-pixel basis.

10. The local dimming driving device according to claim 9, wherein the image analyzer includes:

a maximum value detector detecting and outputting the maximum values per pixel from the input image data; and an average value detector summing and averaging the maximum values per pixel from the maximum value detector on the block-by-block basis, and detecting and outputting average values per block to the dimming value decider, and the dimming value decider selecting and outputting the local dimming values per block corresponding to the average values per block using a predetermined look-up table.

11. The local dimming driving device according to claim 9, wherein the second gain value calculator calculates and outputs the second gain value on a pixel-by-pixel basis by calculating a ratio of a maximum gray scale corresponding to the number of bits of the input image data to the maximum value per pixel.

12. The local dimming driving device according to claim 9, wherein the second gain value calculator calculates the second gain value on a pixel-by-pixel basis using a look-up table in which the characteristics of a ratio of a maximum gray scale corresponding to the number of bits of the input image data to the maximum value per pixel are previously set.

13. A liquid crystal display device comprising:

a local dimming driver analyzing an input image data, generating a local dimming value and compensating an input image data according to the analyzing result;

a panel driver supplying the compensated data from the local dimming driver to a liquid crystal panel;

a timing controller outputting the compensated data from the local dimming driver to the panel driver and controlling driving timing of the panel driver;

a backlight unit including a plurality of light emitting blocks to irradiate light to the liquid crystal panel; and a backlight driver driving the light emitting blocks using the local dimming values per block from the local dimming driver, wherein the local dimming driver comprises:

an image analyzer detecting maximum values per pixel from input image data and analyzing the maximum values per pixel on a block-by-block basis;

a dimming value decider determining and outputting local dimming values per block according to the analysis result from the image analyzer;

a first gain value calculator calculating and outputting a first gain value using the local dimming values per block from the dimming value decider;

a second gain value calculator calculating and outputting a maximum gain value per pixel using the maximum values per pixel from the image analyzer as a second gain value;

a gain value selector selecting and outputting a smaller value of the first gain value from the first gain value calculator and the second gain value from the second gain value calculator as a final gain value; and a data compensator compensating the input image data using the final gain value, wherein the first gain value calculator:

calculates a first total light quantity per pixel by detecting and summing the quantity of light reaching each pixel from a predetermined light profile of a light source when overall luminance of a backlight unit has a maximum value, calculates a second total light quantity per pixel by summing the quantity of light reaching each pixel from the predetermined light profile of the light source multiplied by the local dimming values when the luminance of the backlight unit is controlled by local dimming on the block-by-block basis, and calculates and outputs the first gain value by a ratio of the first total light quantity to the second total light quantity on a pixel-by-pixel basis.

14. The liquid crystal display device according to claim 13, wherein the image analyzer includes:

a maximum value detector detecting and outputting the maximum values per pixel from the input image data; and an average value detector summing and averaging the maximum values per pixel from the maximum value detector on the block-by-block basis, and detecting and outputting average values per block to the dimming value decider, and the dimming value decider selecting and outputting the local dimming values per block corresponding to the average values per block using a predetermined look-up table.

15. The liquid crystal display device according to claim 13, wherein the second gain value calculator calculates and outputs the second gain value on a pixel-by-pixel basis by calculating a ratio of a maximum gray scale corresponding to the number of bits of the input image data to the maximum value per pixel.

16. The liquid crystal display device according to claim 13, wherein the second gain value calculator calculates the second gain value on a pixel-by-pixel basis using a look-up table in which the characteristics of a ratio of a maximum gray scale corresponding to the number of bits of the input image data to the maximum value per pixel are previously set.

17. The liquid crystal display device according to claim 13, wherein the local dimming driver is built in the timing controller.

* * * * *